US009085073B2

(12) United States Patent
Hossack et al.

(10) Patent No.: US 9,085,073 B2
(45) Date of Patent: Jul. 21, 2015

(54) COMBINATION STAPLE HOLDER AND REMOVAL TOOL

(71) Applicants: George Arthur Hossack, Calgary (CA); Michael Cory Diamond, Winnipeg (CA); James Norman Harvie, Winnipeg (CA)

(72) Inventors: George Arthur Hossack, Calgary (CA); Michael Cory Diamond, Winnipeg (CA); James Norman Harvie, Winnipeg (CA)

( * ) Notice: Subject to any disclaimer, the term of this patent is extended or adjusted under 35 U.S.C. 154(b) by 240 days.

(21) Appl. No.: 13/800,599

(22) Filed: Mar. 13, 2013

(65) Prior Publication Data

US 2014/0260813 A1 Sep. 18, 2014

(51) Int. Cl.

| | |
|---|---|
| ***B25C 3/00*** | (2006.01) |
| ***B25C 11/00*** | (2006.01) |
| ***B25F 1/00*** | (2006.01) |

(52) U.S. Cl.

CPC ..... *B25C 3/008* (2013.01); *B25C 11/00* (2013.01); *B25F 1/00* (2013.01)

(58) Field of Classification Search

CPC ..... B25C 3/00; B25C 3/004; B25C 3/006; B25C 3/008; B25C 11/00; B25F 1/00

USPC ..... 81/44; 7/117, 160, 166; 254/28; 227/63

See application file for complete search history.

(56) References Cited

U.S. PATENT DOCUMENTS

| | | | | | |
|---|---|---|---|---|---|
| 350,420 | A | * | 10/1886 | Dillon | 227/147 |
| 493,758 | A | * | 3/1893 | Davidson | 81/44 |
| 1,213,334 | A | * | 1/1917 | Chapman | 81/44 |
| 5,370,293 | A | * | 12/1994 | Bevins | 227/63 |
| 5,933,894 | A | * | 8/1999 | Bates | 81/44 |
| 8,826,775 | B2 | * | 9/2014 | Vienneau et al. | 81/44 |
| 2006/0101948 | A1 | * | 5/2006 | Meitzler et al. | 81/44 |

* cited by examiner

*Primary Examiner* — Hadi Shakeri

(74) *Attorney, Agent, or Firm* — Nikolai & Mersereau, P.A.; Thomas A. Nikolai

(57) ABSTRACT

A tool for stapling cable to a support structure and also removing staples efficiently and without damaging the insulation of the cable is provided. The staple block of the tool securely holds a staple as it is being positioned and then driven into the support structure. The elongated handle virtually eliminates risk of injury to the hand or fingers when driving the staple into the support structure. The extraction member permits staples to be removed without damaging the cable.

7 Claims, 2 Drawing Sheets

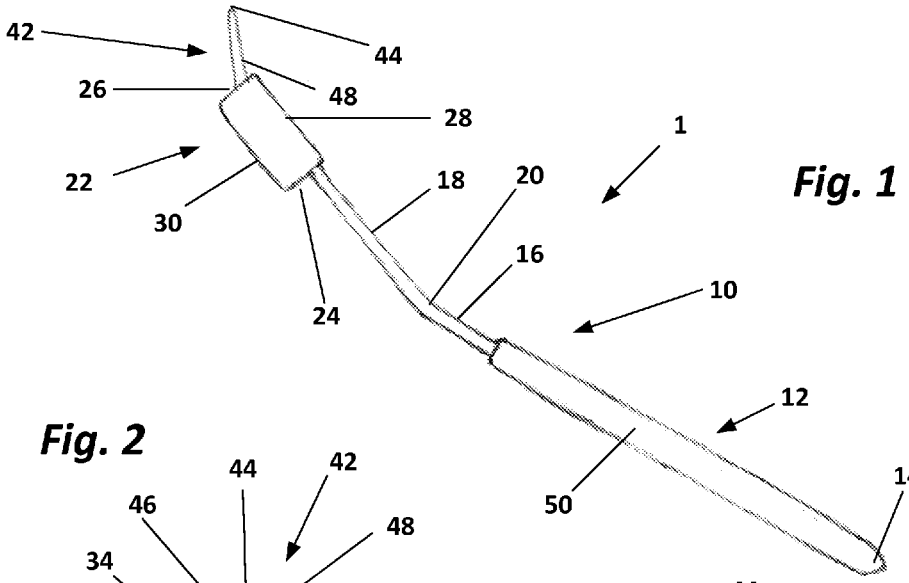
Fig. 1
Fig. 2
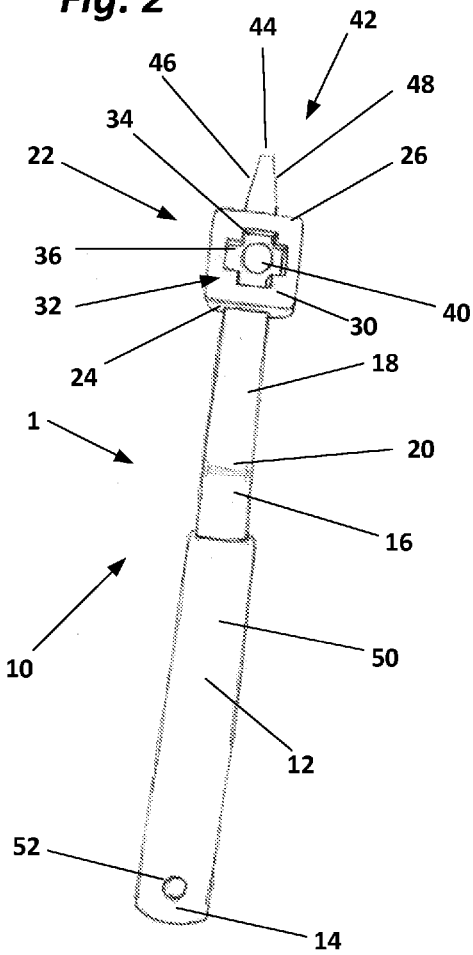
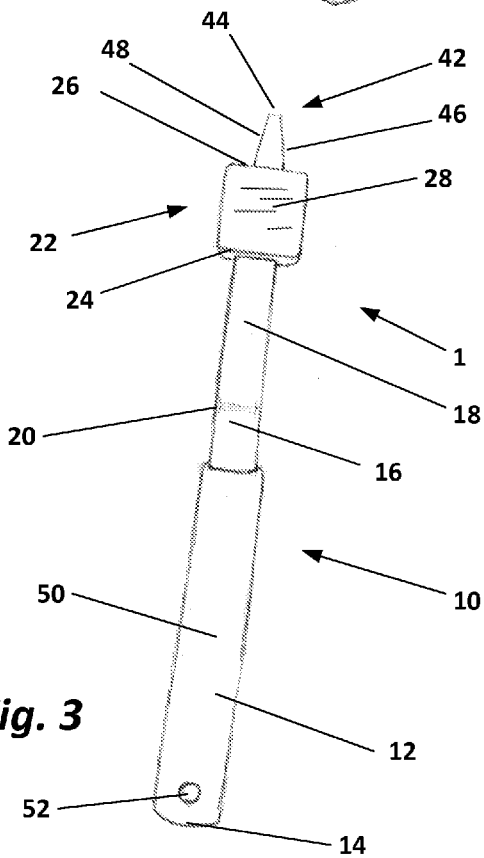
Fig. 3

COMBINATION STAPLE HOLDER AND REMOVAL TOOL

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

I. Field of the Invention

The present invention relates to tools used by electricians and others involved in the installation of wiring or cabling. More specifically, the present invention relates to tools used to staple a wire or cable in place and to remove such staples when it is necessary to move or remove the cable or staple.

The building codes which exist in most areas of North America require electrical and other cables used in construction projects to be securely attached to adjacent support members rather than hang loose. A variety of staple designs are employed to satisfy these building code requirements. While these staples are sometimes made of a bare metal material, such staples typically also include a plastic or other non-conductive member which holds the metal portion of the staple away from the cable as the staple is used to secure the cable to the support structure.

As nearly anyone who has used such staples to secure a wire or cable to a support structure can attest, it is sometimes difficult to hold the wire and staple in place with one hand and secure it in place using a hammer held in the other hand. All too often, the hammer comes into contact with the fingers of the hand holding the staple. The force applied to the hammer to cause the hammer to drive the staple into the support structure can, and often does, cause injury to the fingers of the hand holding the staple and cable. Under certain circumstances, electrical contractors have used an elongated pliers or tweezers to hold the staple in place as it is being set with a hammer. This is done to keep the fingers and hands away from the working end of the hammer. However, the use of such tools to hold the staple is often quite clumsy and leads to increased inefficiency and time in completing the task of securing the cabling to the support structure.

Likewise, a variety of tools have been used to try to extract staples from the support structure. Such tools include screw drivers, picks, pliers, or the like. All too often when such tools are used, the working end of the tool gouges, cuts, penetrates or otherwise damages the insulation of the cable such that the cable is unfit for use. Sometimes such damage to the cable's insulation goes unnoticed creating a potentially hazardous situation.

As one skilled in the art will readily appreciate, damaging the insulation surrounding the wires of a cable may lead to a short circuit or other electrical fault which could cause damage to equipment, injury to people coming into contact with the exposed portion of the wire or even a fire.

In view of the foregoing, there is a real and longfelt need in the industry for a single tool which can be employed by people installing cable to hold a staple as it is being pounded into place and which can further be employed to extract the staple from the support structure without damaging the outer insulation of the cable.

SUMMARY OF THE INVENTION

A novel staple tool includes an integrally formed handle having a first handle section comprising a first end and a second end, and a second handle section extending at an obtuse angle from the second end of the first handle section. The tool also includes a staple block having a handle side, an extractor side opposite the handle side, a strike side, and a recessed side opposite the strike side. The staple block is coupled to the second handle section such that the handle extends from the handle side of the staple block.

The staple block includes a cross-shaped recess extending inwardly from the recess side. This cross-shaped recess has a stipes of a first size and a patibulum of a second size. A magnet is located within the staple block. When the head of a staple is inserted into the cross-shaped recess, the magnet temporarily secures the staple to the staple block as the staple is positioned with respect to a support structure and a member, such as an insulated cable, to be coupled to the support structure with the staple.

The elongated handle of the staple tool permits the user to position the staple while at the same time keeping his or her hands away from the staple. When the staple is so positioned, the staple is at least partially driven into the support structure by applying a force, such as with a hammer, to the strike side of the staple block. This hammering force is transmitted by the staple block to the staple to drive the staple at least partially into the support structure.

When the staple is so coupled to the support structure, the holding forces between the prongs of the staple and the support structure are greater than the holding force of the magnet within the staple block such that the staple tool can be readily removed from the staple.

The staple tool also includes an extraction member projecting from the extractor side of the staple block. The shape of this extraction member, the staple block and the handle permit the tip of the extraction member to be slid between a staple and a cable stapled to a support structure. When the tip is so positioned, the handle can be leveraged to pry the staple loose from the support structure without damaging the insulation of the cable stapled to the support structure.

Various refinements to the invention may be made. For example, the staples typically used in Canada have a different shape than the staples typically used in the United States. The shapes of the staple block, handle and extraction member can all be modified based upon the shapes of such staples without deviating from the invention. Likewise, a hole can be drilled through the first end of the first handle section so that the tool can be hung from a hook or nail. The handle may also be covered with a padded grip for the comfort of the user.

These and other aspects of the present invention will become better understood from a reading of the detailed description of the invention provided below in conjunction with the accompanying drawings, where like elements are numbered alike in the several figures.

BRIEF DESCRIPTION OF THE DRAWINGS

FIG. 1 is a side view of a first embodiment of the present invention, the opposite side view being the mirror image thereof.

FIG. 2 is a bottom view of the embodiment shown in FIG. 1.

FIG. 3 is a top view of the embodiment shown in FIG. 1.

DETAILED DESCRIPTION

Figure 4:
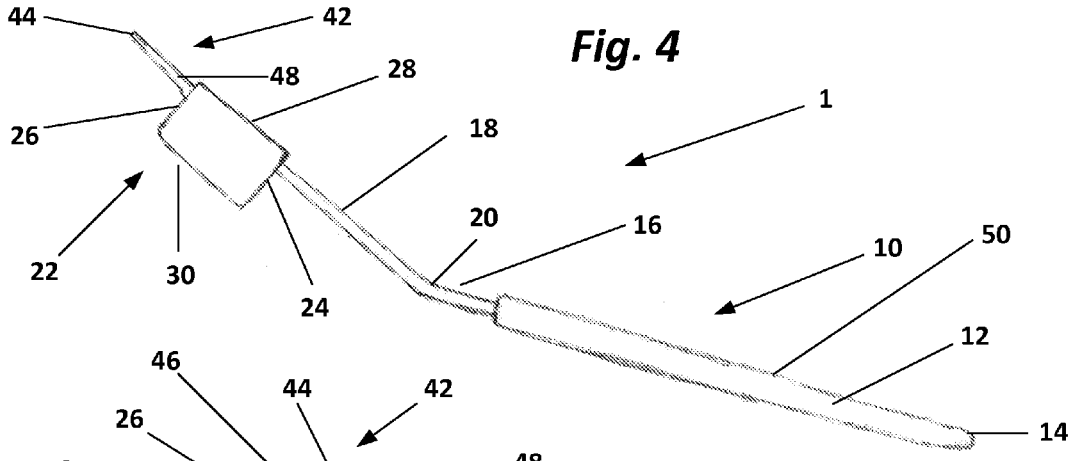
FIG. 4 is a side view of a second embodiment of the present invention, the opposite side view being the mirror image thereof.
Figure 5:
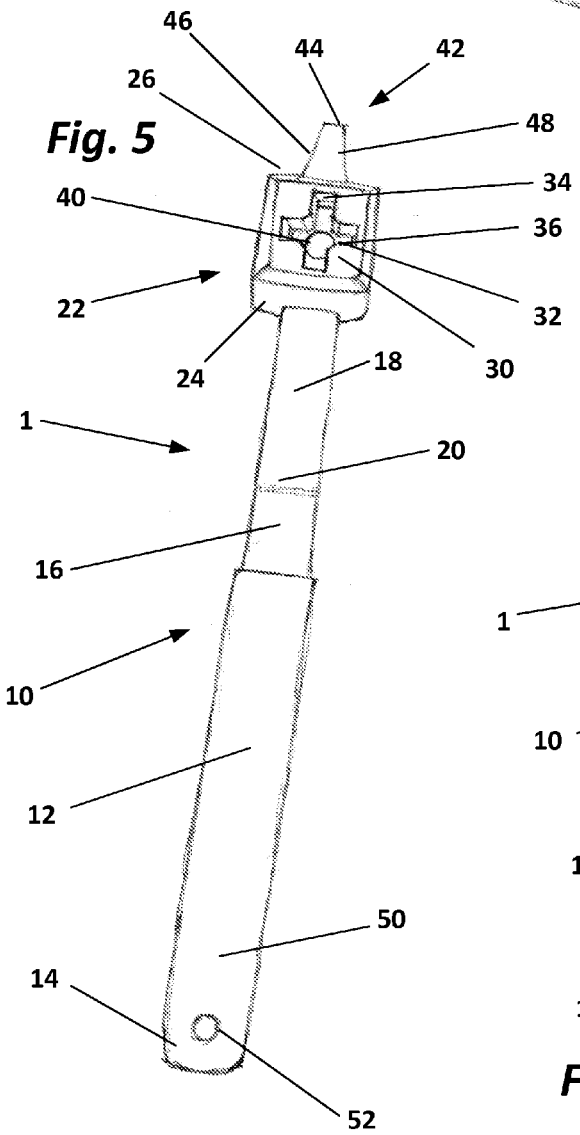
FIG. 5 is a bottom view of the embodiment shown in FIG. 4.
Figure 6:
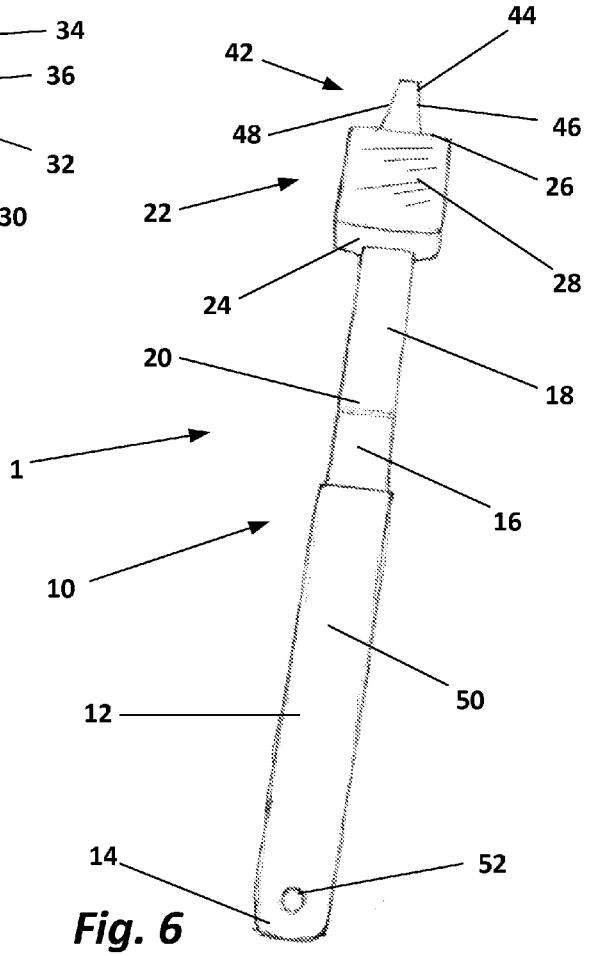
FIG. 6 is a top view of the embodiment shown in FIG. 4.

A first embodiment of a staple tool 1 is shown in FIGS. 1-3. The second embodiment of a staple tool 1 is shown in FIGS. 4-6. In each case, the staple tool 1 includes a handle 10. The handle 10 has a first handle section 12 comprising a first end 14 and a second end 16. The handle also includes a second handle section 18 extending from the second end of the first handle section at an obtuse angle 20.

Coupled to the second handle section 18 is a staple block 22. The staple block has a handle side 24 arranged with the handle 12 such that the handle 12 projects from the handle side 24 of the staple block. Opposite the handle side 24 of the staple block 22 is an extractor side 26. The staple block also includes a strike side 28 which is substantially flat and defines a plane. The strike side 28 is sized to be impacted upon by a hammer. Opposite the strike side 28 is a recess side 30.

As best shown in FIGS. 2 and 4, the staple block 22 has a cross-shaped recess 32 extending into the staple block 22 from the recess side 30. The cross-shaped recess 32 comprises a stipes 34 and a patibulum 36. The stipes 34 and patibulum 36 may be dimensioned differently such that staples having a different size or shape head may be inserted into the cross-shaped recess. For example, the stipes 34 of the cross-shaped recess 32 may be wider than the patibulum 36 of the recess 32 such that a staple with a wider head may be inserted into the stipes 34 and a staple with a narrower staple head inserted into the patibulum 36. Located within the staple block 22 is a magnet 40. This magnet 40 retains a staple inserted into either the stipes 34 or patibulum 36 to temporarily retain the staple within the cross-shaped recess 32.

The staple tool 1 described above may be employed when stapling wires, cables or the like to a support structure. When used for this purpose, the head of a staple is inserted either into the stipes 34 or patibulum 36 of the cross-shaped recess 32. The staple is held in place by the magnet 40 with the prongs of the staple projecting outwardly from the recess 32 past the recess side 30. By holding the handle 10, a user can then position the staple around the wire or cable to be attached to the support structure and further position the staple tool 1 to hold the wire or cable, staple and staple block 22 of the staple tool 1 in close proximity to a support structure with the ends of the staple in contact with the support structure. The length of the handle 10 permits the user to maintain a safe distance between the user's hand and fingers and the strike side 28 of the staple block 22. Using a hammer or other similar device, the user can then strike the strike side 28 with a hammer to drive the staple at least partially into the support structure. Because the holding force between the staple and the support structure is then greater than the magnetic force applied by the magnet 40 to the staple, the staple tool 1 can then be easily removed. If necessary, the user can then strike the staple itself with the hammer to drive the staple further into the support structure. This, however, is typically not required. The design of the staple tool 1 typically ensures the staple prongs have penetrated into the support structure a sufficient distance for the staple to hold the cable, but not so far that the head of the staple damages the insulative outer coating of the cable.

As shown in FIGS. 1-6, the tool of the present invention also includes an extraction member 42. The extraction member extends from the extractor side 26 of the staple block 22 and terminates in a tip section 44. The sides 46 and 48 of the extraction member 42 are tapered such that the tip portion 44 represents the narrowest portion of the extraction member. As shown in FIG. 1, the extraction member 42 may extend from the extractor side 26 at such an angle that the extractor member actually crosses the plane defined by the strike side 28 such that the tip 44 resides on the opposite side of that plane than the staple block 22. As shown in FIG. 4, this is not necessarily the case. The angle at which the extraction member 42 extends from the extractor side 26 of the staple block 22 will depend upon the nature of the staples typically used. The arrangement used in FIG. 1 is ideally suited for staples often used in Canada. Different staples are used in the United States and the arrangement shown in FIG. 4 is much more suitable when extracting those staples.

Other features may be included within the tool without deviating from the invention. For example, to make the tool more comfortable to hold in one's hand, a padded grip 50 may cover the first handle section 12. Likewise, a hole 52 can be drilled through the first end 14 of the first handle section 12 so the tool can be hung from a peg, nail, hook or the like for storage.

In view of the foregoing, one skilled in the art will appreciate that the tool of the present invention permits safe, quick and easy securement of a wire, cable, or other elongated device to a support structure using staples. The staple tool 1 promotes safety because the handle 10 is long enough so that it can be gripped with the hand far enough from the strike surface 28 of the staple block 22 to virtually eliminate the risk that the user's hammer will miss the strike surface 28 and hit the user's hand or fingers. Also, the tool 1 does not cut the insulation of the cable when used to staple the cable to a support structure. The staple tool 1 is quick and easy to use because staples are easily inserted into the cross-shaped recess 32, held there by the magnet 40 and the walls of the cross-shaped recess while the staple is positioned with respect to the staple and support structure and then driven into the support structure. After the staple is driven into the support structure, the tool 1 is readily pulled away from the staple. The staple tool 1 of the present invention is relatively inexpensive to make, is durable, is lightweight and easy to carry and is very useful when stapling wires, cables or the like to a support structure or when removing such staples.

When removing such staples safety and efficiency are promoted. The respective angles of the handle, staple block and extraction members are such that the tip 44 of the extraction member 42 can easily be slid between the staple and the wire or cable being held by the staple without damaging the insulative coating of the wire or cable. The handle can then be used to quickly pry the staple from the support structure again without damaging the insulative covering of the wire or cable.

Those skilled in the art will recognize that other modifications may be made without deviating from the invention. The foregoing descriptions are not intended to be limiting. The invention is only limited by the claims which follow.

What is claimed is:

1. A staple tool comprising:

(a) an integrally formed handle having a first rectilinear handle section comprising a first end and a second end, and a second rectilinear handle section extending at an obtuse angle from the second end of the first handle section;

(b) a staple block having a handle side, an extractor side opposite the handle side, a strike side defining a plane and a recess side opposite the strike side, wherein the staple block is coupled to the second handle section such that the handle extends from the handle side, to form an acute angle with the plane defined by the strike side and wherein the staple block includes a cross-shaped recess extending inwardly from the recess side, the cross-shaped recess having a stipes and a patibulum; and (c) an extraction member projecting from the extractor side of the staple block, wherein the extraction member has a tip, the arrangement being such that the staple block and handle are adapted to enable a user to first position a staple placed in either the stipes or patibulum over a wire or cable to be attached to a support structure with the prongs of the staple in contact with the support structure, and to second strike the strike side of the staple block to at least partially drive the prongs of the staple into the support structure; and (d) wherein the handle, staple block and extraction member are adapted to enable the tip to be inserted between a staple and a wire or cable held to a support member by the staple without damaging any insulative coating of the wire or cable, and enable the tool to pry the staple loose from the support member without damaging any insulative coating of the wire or cable.

2. The staple tool of claim 1 wherein the first handle section is at least partially covered with a padded grip.

3. The staple tool of claim 1 wherein the first handle section has a hole extending therethrough.

4. The staple tool of claim 1 wherein the extraction member projects from the extractor side of the block at an angle such that the tip of the extraction member extends beyond the plane defined by the strike side of the staple block.

5. The staple tool of claim 1 wherein the sides of the extraction member are tapered such that the tip is the narrowest portion of the extraction member.

6. The staple tool of claim 1 wherein the stipes and the patibulum have different sizes.

7. The staple tool of claim 1 wherein the stipes and patibulum have different shapes.

* * * * *